United States Patent [19]

Wolniak et al.

[11] 4,405,843

[45] Sep. 20, 1983

[54] ANTI-STATIC SWITCH LOCK

[75] Inventors: Stanley C. Wolniak, Chicago; Elbert M. Spencer, Wildwood; Ronald L. Brown, Waukegan, all of Ill.

[73] Assignee: The Eastern Company, Naugatuck, Conn.

[21] Appl. No.: 283,938

[22] Filed: Jul. 16, 1981

[51] Int. Cl.[3] ..... H01H 27/06

[52] U.S. Cl. ..... 200/44; 200/295

[58] Field of Search ..... 200/44, 42 R, 307, 304, 200/293, 295

[56] References Cited

U.S. PATENT DOCUMENTS

| | | | |
|---|---|---|---|
| 1,853,075 | 4/1930 | Norviel | 200/44 |
| 3,639,708 | 2/1972 | Wolniak et al. | 200/44 |
| 3,819,883 | 6/1974 | Heap | 200/11 J |
| 3,941,954 | 3/1976 | Wintringham | 200/44 |
| 4,009,357 | 2/1977 | Naylor | 200/42 R |

*Primary Examiner*—John W. Shepperd
*Assistant Examiner*—Renee S. Kidorf
*Attorney, Agent, or Firm*—Wood, Dalton, Phillips, Mason & Rowe

[57] ABSTRACT

An improved anti-static switch lock of the type having a key-operated plug rotatably located within a lock barrel, A nonconductive switch adapting hub connected to the lock barrel and a switch affixed to the hub, actuable upon rotation of the plug. The improvement consisting of a hub and plug design wherein the hub is connected to the lock barrel by resilient legs which engage an annular shoulder within the barrel and the plug extends from the barrel such that it prevents the legs from disengaging the shoulder. A biasing means interconnects the hub and one of the hub legs to bias the rotation of the plug and the switch to a desired position.

5 Claims, 8 Drawing Figures

FIG. 1
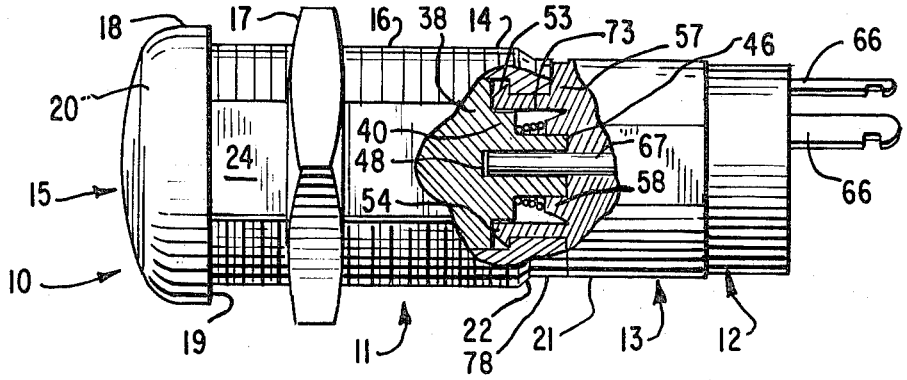
FIG. 2
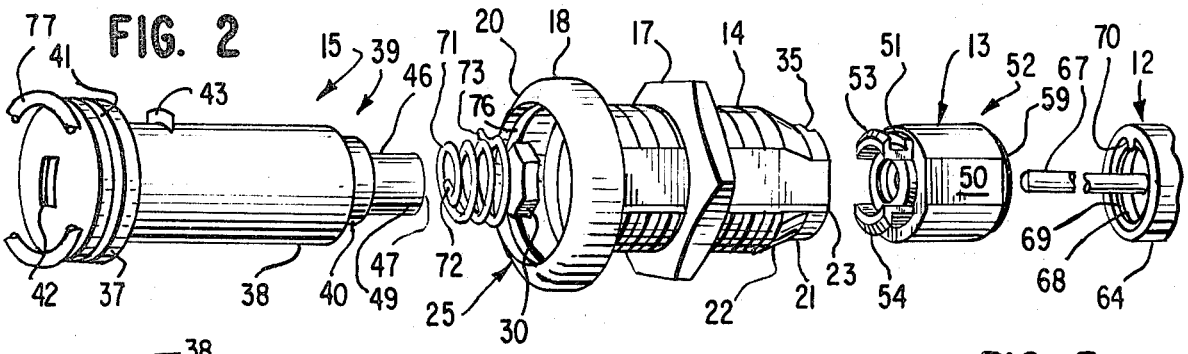
FIG. 3
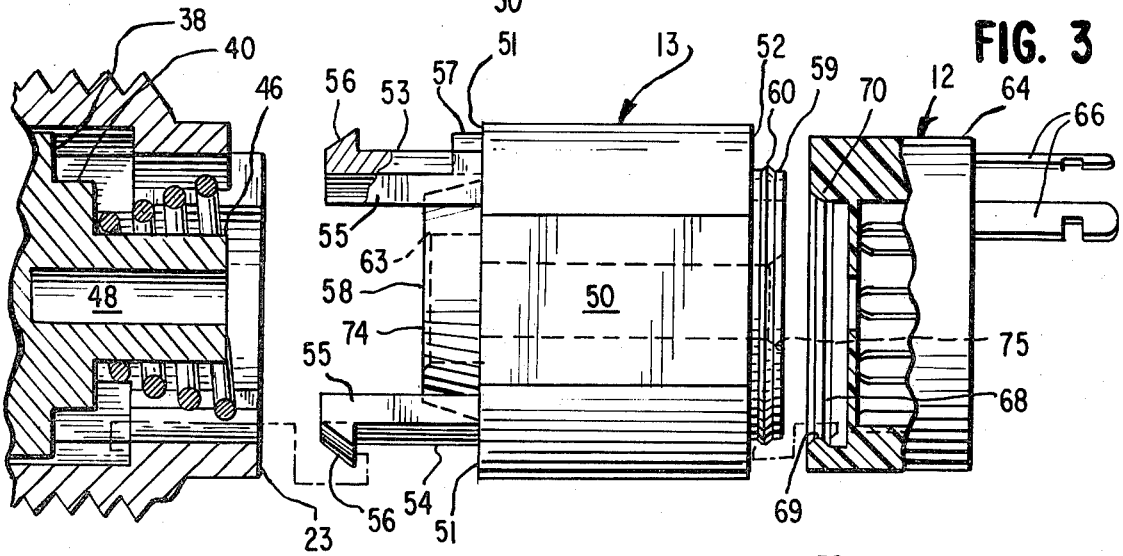
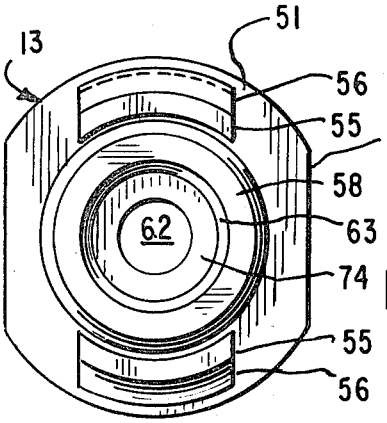
FIG. 4
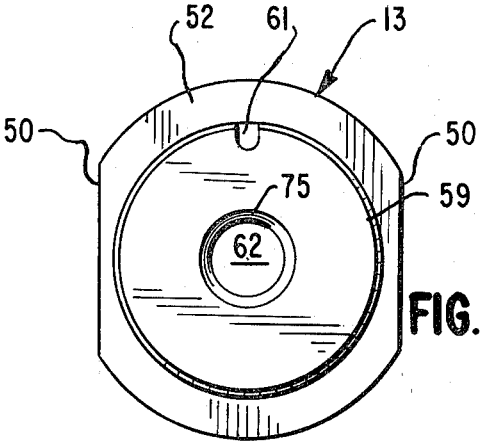
FIG. 5

ANTI-STATIC SWITCH LOCK

BACKGROUND OF THE INVENTION

1. Field of the Invention

This invention relates to anti-static switch locks having a hub interconnecting a lock and a multiterminal electrical switch wherein rotation of the lock is translated into the connection of terminals within the switch. More particularly this invention relates to the hub connection to the lock.

2. Description of the Prior Art

Anti-static switch locks are well-known by those in industry to be an effective means of restricting the operation of electrical switches to only authorized personnel. The switching of electrical contacts can only take place upon unlocking and rotation of a connected lock. Quite often these switch locks also have the ability to insulate the switching mechanism from random static electrical charges which may come in contact with the lock.

One such anti-static switch lock, described in the Naylor U.S. Pat. No. 4,009,357, shows in exemplary fashion, a switch lock heretofore used. The lock is comprised of a metallic barrel housing a rotatable, key operated plug. Affixed to the end of the plug is a shaft which, in turn, has on its end a rotor. The rotor, housed within a terminal assembly, connects the various terminals of the terminal assembly upon rotation of the plug. Holding the terminal assembly to the lock is a nonconductive adapter. The adapter, capable of holding various types of terminal assemblies, has a pair of legs which engage and hold the adapter to the lock. A similar pair of legs engage and hold the terminal assembly to the adapter.

Anti-static switch locks, of the aforementioned structure, experience the problem of disengagement of the adapter legs from the lock shoulders. This disengagement results in disassembly of the switch lock thereby requiring either switch lock replacement or repair. Furthermore, these switch locks do not have a means whereby the switch and plug may be biased toward a specific switch position.

It is therefore the primary object of this invention to overcome the problems confronting the prior art switch locks heretofore discussed.

SUMMARY OF THE INVENTION

Accordingly an anti-static switch lock is provided which prevents the disengagement of the hub legs from the shoulders of the lock and also provides for a biasing means to be interconnected between the hub and the lock plug.

Toward this end an anti-static switch lock is provided wherein the hub has on one end a pair of hook-shaped, resilient legs capable of engaging corresponding shoulders within the lock barrel. The key operated plug, rotatably located within the lock barrel, has an end which extends so as to lie contiguous to the inner surface of the legs thereby preventing the legs from becoming disengaged from the shoulders. Additionally, a biasing means such as a coil spring is interconnected between the plug end and one of the hub legs to bias the rotation of the plug.

The hub has connected to its end opposing the legs a switch assembly which houses a rotor which provides the required switching operations upon rotation thereof. A shaft extends from the rotor through the hub and into the plug whereby rotation of the plug is translated into switching within the switch assembly.

Accordingly it is the object of this application to set forth an anti-static switch lock wherein the nonconductive hub is positively held in engagement with the lock barrel. The extension of the plug prevents inadvertant disengagement of the hub legs from the barrel.

It is also a further object to provide an anti-static switch lock having a simple and reliable means to bias the switch toward a desired position be it locked or unlocked. The spring is included within the switch lock, interconnected between the plug end and one of the legs of the hub, thereby providing a bias to the plug which controls the switching occuring in the switch assembly.

Further objects and advantages of this invention will become apparent from the study of the following portion of the specification, the claims and the attached drawings.

BRIEF DESCRIPTION OF THE DRAWINGS

FIG. 1 is a side view of the assembled anti-static switch lock with a portion cut away to show the connection between the hub, barrel and plug of the lock;

FIG. 2 is an exploded view of the anti-static switch lock;

FIG. 3 shows a side view of the adapter hub and partial section views of the terminal assembly, the lock barrel, and plug;

FIG. 4 is an end view of the adapter hub showing the hub legs;

FIG. 5 is a view of the end of the adapter hub to which the terminal assembly is connected;

DESCRIPTION

Figure 8:
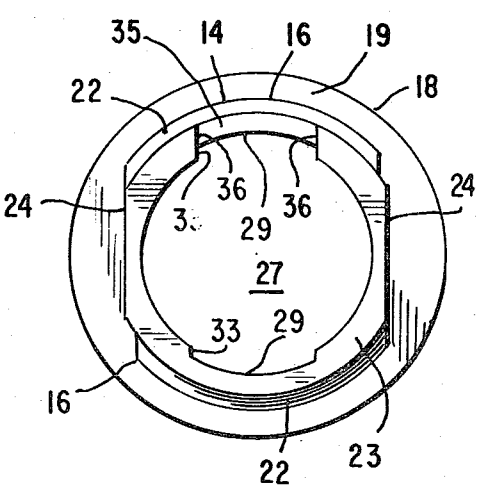
FIG. 8 is a view of the end of the lock barrel to which the adapter hub will attach.

Turning to the drawings FIG. 1 shows the anti-static switch lock 10 to which this application is directed. The switch lock 10 is an assemblage of a key lock assembly 11 attached to a switch assembly 12 by a nonconductive adapter hub 13.

The key lock assembly 11, as shown in FIGS. 1 and 2, is comprised of a cylindrical barrel 14 into which is rotatably mounted a key operated plug 15. The cylindrical barrel 14 has exterior threads 16 which, in cooperation with a nut 17, provide a means to mount the switch lock 10 to a structure such as a panel board. An escutcheon 18 is located on one end of the barrel 14 and has a diameter somewhat larger than said barrel 14 forming, thereby, an annular mounting face 19 which cooperates with the nut 17 to mount said switch lock 10. As can be seen in FIGS. 1 and 2 the escutcheon 18 is disk-shaped having an end face 20 opposing the barrel 14 and mounting face 19. At the opposite end of the barrel 14 is coaxially located a cylindrical hub mount 21 having a diameter somewhat less than that of the barrel 14. An annular chamfer 22 forms the transition from the barrel 14 to the lesser diameter hub mount 21. The end of the hub mount 21 which opposes the chamfer 22 and barrel 14 is planar and orthogonal to the axis of said barrel 14 and hub mount 21 forming thereby a hub engaging surface 23. Extending laterally along the outside of the barrel 14 and the hub mount 21 are a pair of opposing flats 24. As can be seen in FIG. 2 the differing diameters of the barrel 14 and the hub mount 21 results in the flats 24 having a lesser width on the hub mount 21 than on the barrel 14. The flats 24, when the switch lock 10 is mounted in a receptacle having corresponding surfaces, will prevent the inadvertent rotation of the switch lock 10.

Figure 6:
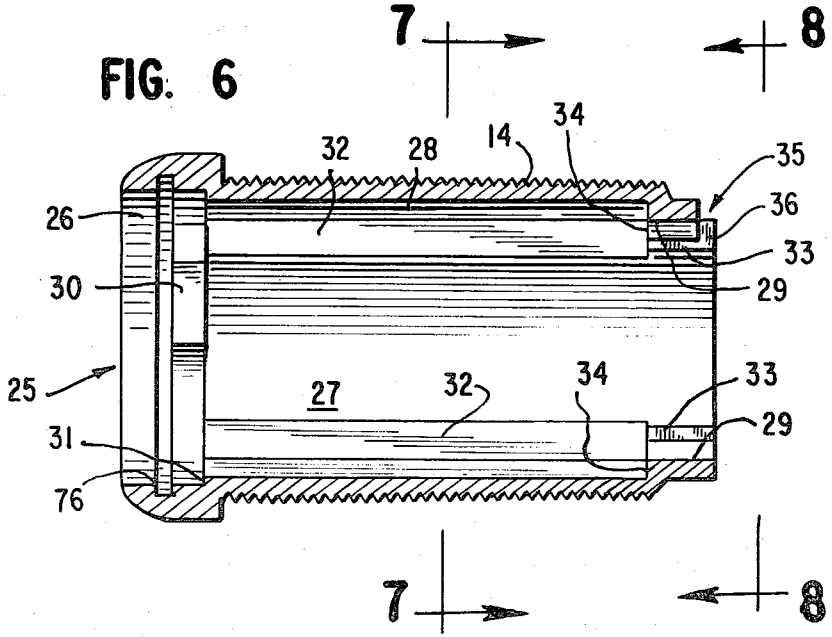
FIG. 6 is a section view of the lock barrel.
Figure 7:
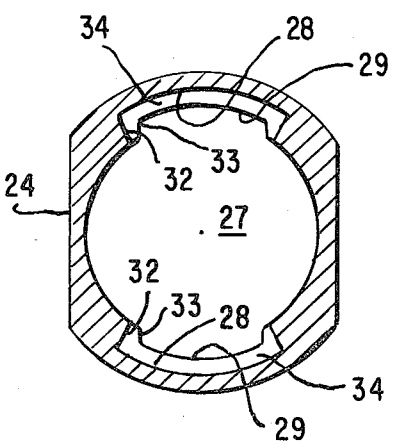
FIG. 7 is a view of the lock barrel along line 7—7 of FIG. 6.

Extending axially through the end face 20 of the escutcheon 18, the barrel 14 and the hub mount 21 is a plug receptacle 25. The plug receptacle 25, as shown in FIGS. 6 and 7 is comprised of a plug locking bore 26, a tumbler bore 27, a pair of tumbler stops 28 and a pair of leg passageways 29. The locking bore 26 extends axially through the end face 20 of the escutcheon 18 to have a terminus near the barrel 14. Circumscribed in the wall of the locking bore 26 is a ring groove 76. A stop segment 30 radially extends inward from the wall of the locking bore to, in cooperation with a notch (not shown) in the plug 15, limit the rotation of the plug 15 within the plug receptacle 25. From the terminus of the locking bore 26, the tumbler bore 27 coaxially extends through the barrel 14 and hub mount 21 to exit from the hub engaging surface 23. The tumbler bore 27 is of a lesser diameter than that of said locking bore 26 thereby creating an annular seat 31 at their juncture. Extending from the annular seat 31 axially along the wall of the tumbler bore 27 to a point just short of the chamfer 22, are a pair of opposing tumbler stops 28. The tumbler stops 28 are arcuate, coaxial grooves having radially directed tumbler stop walls 32 and having an outer diameter slightly less than that of the locking bore 26. As currently contemplated each tumbler stop 28 spans approximately 64° of arc, however it should be noted that the degree of span or configuration of the tumbler stops 28 is not essential for the operation of the switch lock 10 herein set forth.

Extending from the tumbler stops 28 so as to be aligned therewith, a pair of opposing leg passageways 29 pass through the hub engaging surface 23. As can best be seen in FIGS. 6 and 7, the leg passageways 29 are arcuate grooves with parallel passageway walls 33 having an outer diameter less than that of the tumbler stops 28 forming thereby a pair of opposed shoulders 34. These shoulders 34 are, due to the aforementioned structure, arcuate and will provide the mounting surface for securing the hub 13 to the key lock assembly 11.

Extending through the hub mount 21 inward, transverse to the axis of the tumbler bore 27, is the hub aligning notch 35. As can best be seen in FIG. 8, the hub aligning notch 35 has a width somewhat larger than the span of the leg passageways 29, has parallel notch walls 36, and extends from the hub engaging surface 23 toward the barrel 14 for approximately one-half of the length of the hub mount 21. The aligning notch 35 thereby provides the means by which the hub 13 is properly aligned and affixed to the key lock assembly 11.

Viewing FIG. 2, the plug 15 which is inserted into the plug receptacle 25 is seen to be comprised of a plug head 37, a plug shaft 38, and a plug end 39. The plug head 37 is disk-shaped having a diameter so as to be closely received into the locking bore 26 and having a circumscribed groove 41 capable of receiving a retaining ring 77 which serves, with the ring groove 76, to rotatably lock the plug 15 within the plug receptacle 25. Not seen in FIG. 2 is the notch found on the shaft-side of the plug head 37 which, as described above, receives the stop segment 30 to limit the rotation of said plug 15. Extending axially through the plug head 37 and into the plug shaft 38 is a rectangular keyway 42.

Protruding from the keyway 42 through the wall of the plug shaft 38 are a plurality of tumblers 43 (only one of which is shown). The tumblers 43, when the key lock assembly 11 is locked, engage the tumbler stops 28 and more particularly the stop walls 32 thereby preventing rotation of the plug 15 within the barrel 14. A proper key inserted into the keyway 42 will retract the tumblers 43 to allow rotation of the plug 15.

Completing the structure of the plug 15 is the plug end 39. As can be seen in FIG. 2, the plug end 39 is composed of a leg support 40 and a plug extension 46. The leg support 40 is disk-shaped, is of a lesser diameter than and is adjacent to the plug shaft 38, and cooperates with the plug shaft 38 to, as will subsequently be described, prevent the hub 13 from disengaging the key lock assembly 11. Coaxially extending from the leg support 40 away from said plug shaft 38, the plug extension 46 is cylindrical having a flat end 47. As shown in FIG. 3 an axial shaft bore 48 of approximately semicircular shape extends from the end 47 toward and somewhat into the plug shaft 38. The shaft bore 48 will receive the means whereby the rotation of the plug 15 is translated to the switching occurring in the terminal assembly 12. Extending somewhat radially outward from the shaft bore 48 is a bias receiving slot 49 as shown in FIG. 2. The slot 49, stretches from the length of the plug extension 46 toward and through the end 47 and will serve to mount one end of the biasing means subsequently described.

Turning to FIGS. 2 through 5, the structure of the nonconductive hub 13 is illustrated. In this embodiment of the switch lock 10, the hub 13 formed of nonconductive material is cylindrical, of a diameter equal to that of the hub mount 21, and has a pair of opposing hub flats 50 which correspond to the flats 24 of the key lock assembly 11. The two ends of the hub 13 are flat and orthogonal to the axis of the hub 13 and designate the key lock end 51 opposed by the switch end 52.

Transversely protruding from the key lock end 51 are the resilient first and second arcuate hub legs 53 and 54. The concentric first and second hub legs 53 and 54 lie inward of the periphery of the hub 13 and have arc length such that they may be closely received by the leg passageways 29 for engagement of the shoulders 34.

The first hub leg 53 has a C-shaped cross-section. To achieve the C-shape, the transverse member 55 has radially directed therefrom a triangular tip 56 opposed by a rectangular base 57 adjacent to the key lock end 51. The base 57, which distinguishes the first hub leg 53 from the second hub leg 54, will be received by the hub aligning notch 35 when the hub 13 is connected to the key lock assembly 11. Opposing the first hub leg 53, the second hub leg 54 has a transverse member 55 and a triangular tip 56 identical to that of the first hub leg 53, however as stated above, the second hub leg 54 does not have a base 57.

Concentrically located between the first and second hub legs 53 and 54 is a truncated, conical plug seat 58. The plug seat 58 protrudes from the key lock end 51 to provide a support and seat for the plug extension 46 when the switch lock 10 is assembled and to prevent the trapping of the biasing means between the plug extension 46 and the key lock end 51 of the hub 13.

An axial seat bore 74 of a size to closely receive the plug extension 46, as shown in FIGS. 3 and 4, extends from the key lock end 51 through the plug seat 58. A first countersink 63 associated with the seat bore 74 guides the insertion of the plug extension 46 therein.

Coaxially located on the switch end 52 of the hub 13 is a cylindrical switch mount 59. As seen in FIGS. 3 and 5 the switch mount 59 extends orthogonally from the switch end 52 and has a circumferential, triangular lip 60 thereon. The switch mount 59 with its accompanying lip 60 will provide for the snapping connection between said hub 13 and the switch assembly 12. A switch aligning notch 61, as shown in Fig. 5, extends radially into the switch mount 59 to provide a means by which the switch assembly 12 may be connected to the hub 13 only if said switch assembly 12 and hub 13 are properly aligned.

A shaft passageway 62 axially extends through the hub 13 to allow the rotation transmission means to pass from the plug 15 therethrough for communication with the switch assembly 12. A second countersink 75 associated with the shaft passageway 62 guides the assembly of hub 13 and the switch assembly 12.

The switch assembly 12 shown in FIGS. 2 and 3 has a hollow, electrically insulating cylindrical body 64 housing electrical conducting contacts (not shown) therein with terminals 66 extending outward therefrom. Depending upon the desired characteristics of the switch lock 10, the switch assembly 12 can have any number of arrangement of contacts and terminals 66. Housed within the body 64 for rotation therein is an electrically non-conducting rotor carrying a conductive roller (not shown), said rotor having a non-conductive shaft 67 of a cross-sectional shape so as to be closely received by the shaft bore 48 connected thereto. Turning of the shaft 67, which protrudes axially from the switch assembly 12, rotates the rotor causing the roller to electrically connect or disconnect the various contacts. In this manner, switching can occur since the interconnecting of contacts by the roller determines how electricity flows or does not flow through the terminals 66. In the most simple case the roller will connect a pair of contacts to allow the flow of electricity from one terminal 66 to another terminal 66. Roller movement out of interconnecting engagement will disconnect the flow of electricity.

Opposing the terminals 66 of the switch assembly 12 is a cylindrical recess 68. As seen in FIGS. 2 and 3, the recess 68 has an outer diameter such that it may closely receive the switch mount 59 and lip 60. An annular, inward directed rim 69 is located within said recess 68 such that when the switch assembly 12 is pressed upon the hub 13, the rim 69 will snap over the lip 60 of the switch mount 59 thereby firmly securing said switch assembly upon the hub 13. A finger 70 extends radially into the recess 68 and is of a size and shape to be received by the switch aligning notch 61 thereby assuring proper alignment of the hub 13 and switch assembly 12.

To assemble the switch lock 10, the switch assembly 12 having the desired switch configuration is positioned such that its shaft 67 passes through the shaft passageway 62 of the hub 13. The switch assembly 12 is aligned such that the recess 68 and more particularly the finger 70 is aligned with the switch mount 59 and the switch aligning notch 61. Pressing the switch assembly 12 onto the hub 13 causes the rim 69 to snap around the switch mount 59 and the finger 70 to be located in the switch aligning notch 61.

The hub 13, with the attached switch assembly 12, is aligned and pressed onto the hub mount 21 such that the first and second hub legs 53 and 54 are extended through the leg passageways 29 and the leg tips 56 engage the shoulders 34 as shown in FIG. 1. Due to the resilience of the first and second hub legs 53 and 54, said legs snap into engagement with the shoulders 34 as the hub 13 is forced upon the hub mount 21. It should also be noted that the base 57 of the first hub leg 53 is seated within the hub aligning notch 35 insuring the proper alignment of the hub 13 and the hub mount 21. In this position, the shaft 67 extends into the tumbler bore 27.

Once the hub 13 with the attached switch assembly 12 is properly affixed to the hub mount 21, the plug 15 is inserted into the plug receptacle 25. Prior to insertion of the plug 15, a biasing spring 71, as shown in FIG. 2, is located so as to encircle the plug extension 46. One end 72 of the spring 71 is inserted into the slot 49 thereby supporting said one end 72. Additionally, the locking ring 77 is positioned within the groove 41. Inserting the plug 15 into the plug receptacle 25, the plug extension 46 receives the shaft 67 within the mating shaft bore 48. As the plug extension 46 passes between said first and second hub legs 53 and 54 the plug 15 must be partially rotated so as to receive the stop segment 30 within the notch (not shown) and so as to pre-bias the spring 71. The aforementioned plug 15 rotation causes the free end 73 of the spring 71 to encounter, due to its shape, either the first or second hub leg 53 or 54. Since the one end 72 of the spring 71 is held in the slot 49, rotation of the plug 15 causes the spring 71 to somewhat collapse about the plug extension 46 and exert a bias upon the plug 15. The locking ring 77 in the groove 41 is received by the ring groove 76 thereby locking the plug 15 within the plug receptacle 25 in the position shown in FIG. 1. The plug head 37 is thereby rotatably held within the plug receptacle 25, said rotation limited by the stop segment 30.

As best shown in FIGS. 1 and 3 the aforementioned insertion and securing of the plug 15 within the plug receptacle 25 results in the leg support 40 lying adjacent to the transverse members 55 and the plug shaft 38 lying adjacent to the tips 56 of the first and second hub legs 53 and 54. The plug shaft 38 is contiguous to the end of the transverse members 55 thereby preventing axial movement of the hub 13 and more particularly the first and second hub legs 53 and 54. The leg support 40 is located closely to the transverse members 55 opposite to the triangular tips 56 to prevent radial disengagement of the first and second hub legs 53 and 54 from the shoulders 34. It should also be noted that the spring 71 is disposed between the leg support 40 and the plug support 58 which prevents the spring 71 from becoming lodged within the seat bore 74 or between the first and second hub legs 53, 54 and the plug seat 58. Spring location in either position would, as a result of rotation of the plug 15, cause the spring 71 to collapse and bind further plug 15 rotation.

The complete insertion and securing of the plug 15 within the plug receptacle 25 results, as shown in FIG. 1 in the location of the plug extension 46 within the seat bore 74 of the plug seat 58. In this position the end 47 of the plug extension 46 lies contiguous to the key lock end 51 of the hub 13 and the spring 71 is seated between said plug seat 58 and the leg support 40 thereby preventing disengagement of said spring 71 from said plug extension 46.

The above assembled switch lock 10 is connected to a support such as a panel board and the terminals 66 are electrically connected to an electronic circuit. A person desiring to operate the switch lock 10, either to start, discontinue, or otherwise affect the flow of electricity from the circuit through the terminals 66 inserts a proper key into the keyway 42 and rotates the plug 15 within the plug receptacle 25 against the bias exerted by the spring 71. Due to the cylindrical nature of the leg support 40, the first and second hub legs 53 and 54 are maintained in engagement with the shoulders 34. This rotation, is translated by the shaft 67 into the interconnecting or disconnecting of the contacts by the roller carried by the rotor which in turn achieves the desired switching of the flow of electricity through the terminals 66. Should the person inserting the key inadvertently discharge static electricity to the key lock assembly 11, the non-conductive hub 13, terminal assembly 12 and its shaft 67 will prevent the static charge from reaching and damaging the electronic circuit.

While we have shown and described certain embodiments of a switch lock, it is to be understood that it is capable of many modifications. For example, the key lock assembly 11 may consist of other suitable means to provide for the locking of a rotatable plug element or the switch lock may be assembled without a spring 71. Changes, therefore, in the construction may be made without departing from the spirit and scope of the device set forth above and as described in the attached claims.

We claim:

1. In an improved switch lock having a lock with a barrel, a plug extending into one end of the barrel and rotatable therein and a nonconductive hub with resilient mounting legs extending into the other end of the barrel having outwardly extending surfaces engaging shoulders in the barrel to hold the hub to the barrel, the improvement comprising:

a shaft on said plug adjacent the end of each leg to prevent axial movement of the hub; and a leg support on said plug extending axially from said plug shaft to lie radially adjacent to the inside of said legs to prevent radial movement thereof.

2. An improved switch lock as described in claim 1 wherein said plug shaft and said leg support are cylindrical, said leg support extending coaxially from and having a lesser diameter than said plug shaft.

3. In an improved switch lock having a lock with a barrel, a plug extending into one end of the barrel and rotatable therein and a nonconductive hub having resilient mounting legs extending into the other end of the barrel, said legs having outwardly extending surfaces engaging shoulders in the barrel to hold the hub to the barrel, the improvement comprising:

a shaft on said plug axially adjacent to said legs, preventing axial movement of the hub;

a leg support on said plug disposed radially inward of and extending coaxially from said shaft to lie radially adjacent to said legs to prevent radial movement of said legs;

an extension on said shaft disposed radially inward of and projecting coaxially from said leg support;

a seat on the hub between the legs, said seat having a bore to receive a portion of said plug extension; and a coil spring to bias the rotation of said plug, said spring surrounding said extension and having one end attached to said extension and the other end bearing against one of said legs, said spring disposed between said leg support and said seat to prevent said spring from engaging said legs or said seat and binding the rotation of said plug.

4. The switch lock described in claim 3 wherein said extension has an axially extending slot to receive one end of said spring.

5. The switch lock described in claim 3 wherein said seat is conical and projects outward from said hub, said seat receiving a portion of said extension and confining said spring between said leg support and said seat to prevent said spring from engaging said legs or said seat and binding the rotation of said plug.

* * * * *